US009145784B2

(12) United States Patent
Evans et al.

(10) Patent No.: US 9,145,784 B2
(45) Date of Patent: Sep. 29, 2015

(54) ANNULUS FILLER SYSTEM

(75) Inventors: Dale E. Evans, Derby (GB); Ian C. D. Care, Derby (GB)

(73) Assignee: ROLLS-ROYCE plc, London (GB)

( * ) Notice: Subject to any disclaimer, the term of this patent is extended or adjusted under 35 U.S.C. 154(b) by 725 days.

(21) Appl. No.: 13/427,241

(22) Filed: Mar. 22, 2012

(65) Prior Publication Data

US 2012/0263595 A1 Oct. 18, 2012

(30) Foreign Application Priority Data

Apr. 14, 2011 (GB) ..... 1106278.3

(51) Int. Cl.
*F01D 11/08* (2006.01)
*F01D 11/00* (2006.01)
*F01D 5/30* (2006.01)

(52) U.S. Cl.
CPC ..... *F01D 11/008* (2013.01); *F01D 5/3092* (2013.01); *F05D 2300/603* (2013.01)

(58) Field of Classification Search
CPC F01D 11/008; F01D 5/3092; F05D 2300/603
USPC ..... 416/193 R, 193 A, 186 R, 219 R, 220, 416/221, 2
See application file for complete search history.

(56) References Cited

U.S. PATENT DOCUMENTS 3,132,841 A * 5/1964 Wilder, Jr. ..... 416/219 R
3,294,364 A * 12/1966 Stanley ..... 416/219 R
3,640,640 A * 2/1972 Palfreyman et al. ..... 416/2
3,679,324 A * 7/1972 Stargardter ..... 416/229 R
3,784,320 A * 1/1974 Rossmann et al. ..... 416/215
3,801,222 A 4/1974 Violette
3,809,495 A * 5/1974 Stahl ..... 416/135
4,207,029 A * 6/1980 Ivanko ..... 416/241 B
4,343,593 A * 8/1982 Harris ..... 416/193 A
4,417,854 A * 11/1983 Cain et al. ..... 416/241 B
4,655,687 A 4/1987 Atkinson
4,802,824 A 2/1989 Gastebois et al.
5,018,271 A * 5/1991 Bailey et al. ..... 29/889.71
5,281,096 A * 1/1994 Harris et al. ..... 416/193 A (Continued)

FOREIGN PATENT DOCUMENTS

EP 1 067 274 A1 1/2001
FR 2 608 674 6/1988
GB 822067 10/1959

OTHER PUBLICATIONS

British Search Report dated Aug. 5, 2011 issued in British Patent Application No. 1106278.3.

*Primary Examiner* — Nathaniel Wiehe
*Assistant Examiner* — Wayne A Lambert
(74) *Attorney, Agent, or Firm* — Oliff PLC

(57) ABSTRACT

An annulus filler system bridges the gap between two adjacent blades attached to a rim of the rotor disc of a gas turbine engine. The system includes an annulus filler having a lid which extends between the adjacent blades and defines an airflow surface for air being drawn through the engine. The filler also has a support body extending beneath the lid and terminating in an elongate foot which, in use, extends along a groove provided in the rim of the disc. The groove has a neck which prevents withdrawal of the foot through the neck in a radially outward direction of the disc. The system further includes a sleeve which, after installation of the filler, is slidably locatable into a gap between the foot and sides of the groove.

15 Claims, 4 Drawing Sheets

(56) References Cited

U.S. PATENT DOCUMENTS

| | | | | |
|---|---|---|---|---|
| 5,314,307 | A * | 5/1994 | Farmer | 416/2 |
| 5,368,444 | A | 11/1994 | Anderson | |
| 5,421,704 | A * | 6/1995 | Carletti et al. | 416/193 A |
| 5,464,326 | A | 11/1995 | Knott | |
| 5,573,377 | A * | 11/1996 | Bond et al. | 416/229 A |
| 5,890,874 | A | 4/1999 | Lambert et al. | |
| 6,132,175 | A | 10/2000 | Cai et al. | |
| 6,217,283 | B1 | 4/2001 | Ravenhall et al. | |
| 6,312,224 | B1 | 11/2001 | Knott et al. | |
| 6,514,045 | B1 | 2/2003 | Barton et al. | |
| 6,832,896 | B1 | 12/2004 | Goga et al. | |
| 2002/0044870 | A1 | 4/2002 | Simonetti et al. | |
| 2008/0018056 | A1 | 1/2008 | Evans | |
| 2009/0004017 | A1 * | 1/2009 | Belmonte et al. | 416/219 R |
| 2009/0269203 | A1 | 10/2009 | Care et al. | |
| 2010/0040472 | A1 | 2/2010 | Read et al. | |
| 2010/0054937 | A1 * | 3/2010 | Beckford et al. | 416/2 |
| 2010/0054938 | A1 * | 3/2010 | Beckford et al. | 416/2 |
| 2011/0206530 | A1 * | 8/2011 | Fabre | 416/229 R |

* cited by examiner

ANNULUS FILLER SYSTEM

FIELD OF THE INVENTION

The present invention relates to an annulus filler system for bridging the gap between adjacent blades of a gas turbine engine stage.

BACKGROUND OF THE INVENTION

With reference to FIG. 1, a ducted fan gas turbine engine generally indicated at 10 has a principal and rotational axis X-X. The engine comprises, in axial flow series, an air intake 11, a propulsive fan 12, an intermediate pressure compressor 13, a high-pressure compressor 14, combustion equipment 15, a high-pressure turbine 16, and intermediate pressure turbine 17, a low-pressure turbine 18 and a core engine exhaust nozzle 19. A nacelle 21 generally surrounds the engine 10 and defines the intake 11, a bypass duct 22 and a bypass exhaust nozzle 23.

The gas turbine engine 10 works in a conventional manner so that air entering the intake 11 is accelerated by the fan 12 to produce two air flows: a first air flow A into the intermediate pressure compressor 13 and a second air flow B which passes through the bypass duct 22 to provide propulsive thrust. The intermediate pressure compressor 13 compresses the air flow A directed into it before delivering that air to the high pressure compressor 14 where further compression takes place.

The compressed air exhausted from the high-pressure compressor 14 is directed into the combustion equipment 15 where it is mixed with fuel and the mixture combusted. The resultant hot combustion products then expand through, and thereby drive the high, intermediate and low-pressure turbines 16, 17, 18 before being exhausted through the nozzle 19 to provide additional propulsive thrust. The high, intermediate and low-pressure turbines respectively drive the high and intermediate pressure compressors 14, 13 and the fan 12 by suitable interconnecting shafts.

Conventionally, a compressor rotor stage comprises a plurality of radially extending blades mounted on a disc. The blades are mounted on the disc by inserting a root portion of the blade in a complementary retention groove in the outer face of the disc periphery. To ensure a radially smooth inner surface for air to flow over as it passes through the stage, annulus fillers can be used to bridge the spaces between adjacent blades. Typically, a seal between the annulus fillers and the adjacent fan blades is also provided by resilient strips bonded to the annulus fillers adjacent the fan blades.

Annulus fillers of this type are commonly used in the fan stage. The fillers may be manufactured from relatively lightweight materials and, in the event of damage, may be replaced independently of the blades It is known to provide annulus fillers with features for removably attaching them to the rotor disc. An annulus filler may be provided with a hook member at its axially rear end, the hook member sliding into engagement with part of the rotor disc and/or a component located axially behind the rotor assembly, for example a rear fan air seal. Typically, such an annulus filler is slid axially backwards over the rotor disc following an arc which matches the chord-wise curvatures of the aerofoil surfaces of the adjacent blades until the hook member engages, and is then retained in place by a front attachment disc which is fastened over the fronts of all the annulus fillers located around the rotor disc.

US 2010/0040472 proposes another form of annulus filler having an outer part which defines an airflow surface for air being drawn through the engine and a separate support part which is connectable to the outer part and to the rotor disc to support the outer part on the rotor disc. The support part spaces the outer part from the rotor disc and has an inter-engaging portion that in use connects to the rotor disc and has a further inter-engaging portion that in use connects to the outer part. The support part can be fitted first to the disc and the outer part fitted to the support part thereafter.

U.S. Pat. No. 4,655,687 proposes an annulus filler that can be fitted to the rotor disc in a radial direction of the disc. The annulus filler that has a salient foot that is shaped similarly to re-entrant grooves formed in the disc rim between pairs of adjacent blades. The foot is proportioned so as to pass radially of the disc through the neck of a respective groove. Wedges positioned between opposing walls of the grooves and respective feet then prevent withdrawal of the feet in a direction radially outwardly of the disc.

SUMMARY OF THE INVENTION

An aim of the present invention is to provide annulus fillers that are suitable for use with composite blades. In particular, as such blades are lighter than metal blades and the casing containment system for them in the event of a blade off event also tends to be lighter, it is desirable for an annulus filler to be securely attached to the disc to reduce the likelihood of its detachment e.g. during a bird strike or blade off event. It is also desirable that the filler is lightweight to increase engine efficiency and to reduce the energy of impact on the containment system and blades if parts of the annulus filler should be released.

Accordingly, a first aspect of the present invention provides an annulus filler system for bridging the gap between two adjacent blades attached to a rim of the rotor disc of a gas turbine engine, the system including:

- an annulus filler having a lid which extends between the adjacent blades and defines an airflow surface for air being drawn through the engine, and a support body extending beneath the lid and terminating in an elongate foot which, in use, extends along a groove provided in the rim of the disc, the groove having a neck which prevents withdrawal of the foot through the neck in a radially outward direction of the disc, and
- a sleeve which, after installation of the filler, is slidably locatable into a gap between the foot and sides of the groove;
- wherein the sleeve is configured to be permanently deformable to allow a rocking movement of the filler about the foot in response to lateral movement of the adjacent blades which is at least of a magnitude to cause the adjacent blades to contact each other.

Thus, even after an extreme event, such as a bird strike or a blade off, the annulus filler should be able to remain attached to the disc rim via the foot, thereby avoiding damage to the blades or casing arising from a detached filler. Further, the deformed sleeve allows the filler to rock, while remaining attached to the rim, thereby reducing contact stresses where the filler contacts the moved blade(s). The deformed sleeve may also allow the filler to move radially to an extent (while remaining attached to the disc by its foot), which can further help to reduce contact stresses.

The annulus filler system may have any one or, to the extent that they are compatible, any combination of the following optional features.

Conveniently, the foot may be proportioned to pass through the neck of the groove in a radial direction on installation of the filler. The sleeve can then be proportioned to prevent withdrawal of the foot through the neck, after installation of the filler, in a radially outward direction of the disc. Additionally, the sleeve can be further configured to retain sufficient integrity after said permanent deformation to still prevent withdrawal of the foot through the neck in a radially outward direction of the disc.

Typically, the groove extends in substantially an axial direction of the engine, i.e. substantially aligned with retention slots in the disc rim for retaining the blades. The groove may follow a straight or a curved path from the front to the rear of the disc. The walls of the groove may be parallel, or the groove may taper from one end to another.

The sleeve may have a stop which engages with the rim to prevent the sleeve from sliding beyond its intended location position.

The annulus filler may further have sealing strips along the edges of the lid to seal to the adjacent blades.

The sleeve may be at least partially wire-reinforced or fibre-reinforced to maintain the integrity of the sleeve after the deformation. The sleeve may have one or more crushable or frangible zones which provide the permanent deformation. For example, the sleeve may have one or more fibre-reinforced composite layers which maintain the integrity of the sleeve. The material of the crushable or frangible zones may be provided by brittle ceramic or plastic-based material. For example a ceramic foam material impregnated with a thermoplastic elastomer, a fluorocarbon, or a fluorosilicone may be used. This gives a rigid structure in normal use, and a resilient structure with damping under extreme loads. The crushable or frangible zones may be one or more layers of the sleeve. The surfaces of the sleeve can be coated or lubricated, e.g. with polytetrafluoroethylene, to provide an anti-frettage finish. By crushable or frangible it is meant that the integrity of the material is lost causing at least some of the material in the zone to become separated from the other material.

The sleeve and/or filler foot may have differing thicknesses/sections at different distances along the groove. In general the outer surface of the sleeve conforms to the axial slot geometry. This allows, for example, a reduced sleeve thickness at the trailing edge end of the groove, whereby larger amounts of blade lateral movement can be accommodated at the leading edge than at the trailing edge.

Typically, the sleeve wraps around the foot to extend from one side of the neck to the other.

The sleeve may be configured to protrude past the neck of the groove and to flare outwardly away from the support body. In this way, free edges of the sleeve outside the groove can be kept away from the support body of the annulus filler, avoiding damage to the support body from those edges.

Low load areas of the sleeve may be removed to reduce weight. For example, the sleeve may contain weight-saving apertures. Additionally, or alternatively, the sleeve may have a plurality of crushable or frangible zones which wrap around the foot (i.e. extend from one side of the neck to the other and preferably protrude past the neck.) and provide the permanent deformation, adjacent crushable zones being spaced from each other by a weight-saving connecting portion of the sleeve which does not wrap around the foot. For example, the sleeve may have a fore crushable zone, an aft crushable zone, and a connecting portion in the form of a spine which extends along the bottom of the groove to join the crushable zones together.

Typically, the foot has a dovetail-shaped cross-section. The groove can be correspondingly dovetail-shaped in cross-section. Alternatively, however, the foot may have a circular cross-section, e.g. on a stalk extending from the support body.

Preferably, the foot is formed from fibre-reinforced plastic material. Preferably, the lid is formed from fibre-reinforced plastic.

The support body may have a pair of side walls, each side wall joining a respective edge of the lid to the foot to give the support body a V-shaped cross-section. As the V-shaped cross-section supports the lid at its edges, the edges of the lid are less likely to disintegrate during an extreme event. Preferably, the side walls are formed from fibre-reinforced plastic. Preferably a cavity formed by the lid and the two side walls contains a foam core, e.g. formed from a plastic material such as a foamed resin or syntactic foam. The foam core can provide a stiffer filler structure, more able to retain its shape. Alternatively, however, the cavity may contain a chopped fibre composite, e.g. a chopped carbon fibre in a resin such as epoxy, preferably with lightweight additives such as small hollow glass beads.

An annulus filler in which the lid, support body and foot are all formed of composite or plastic material can be made very lightweight, helping to increase the efficiency of the engine.

The support body may have a line of weakness at the connection of the foot to the body. In this way, the support body and lid can be made to detach from the foot and leave the rim if the lateral movement of the blades is so extreme that to remain attached would cause more damage to the surrounding components.

A second aspect of the present invention provides a sleeve of the annulus filler system according to the first aspect.

A third aspect of the present invention provides an annulus filler of the annulus filler system according to the first aspect.

A fourth aspect of the present invention provides a rotor assembly for a gas turbine engine including:

- a rotor disc,
- a plurality of blades attached to a rim of the disc of a gas turbine engine, and
- annulus filler systems according to the first aspect bridging the gaps between adjacent blades;
- wherein respective grooves are provided in the rim, the feet of the annulus fillers extending along the grooves, and the sleeves being located in the gaps between the feet and the sides of the grooves.

Preferably, the rotor disc is a fan disc. The blades may be formed of composite material.

BRIEF DESCRIPTION OF THE DRAWINGS

Embodiments of the invention will now be described by way of example with reference to the accompanying drawings in which.

DETAILED DESCRIPTION

Figure 1:
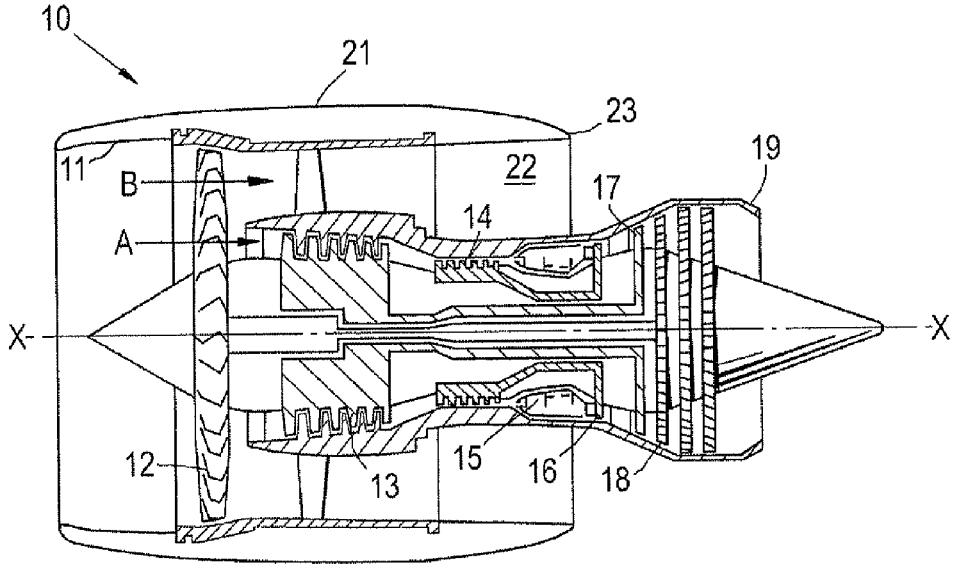
FIG. 1 shows a longitudinal section through a ducted fan gas turbine engine.
Figure 2:
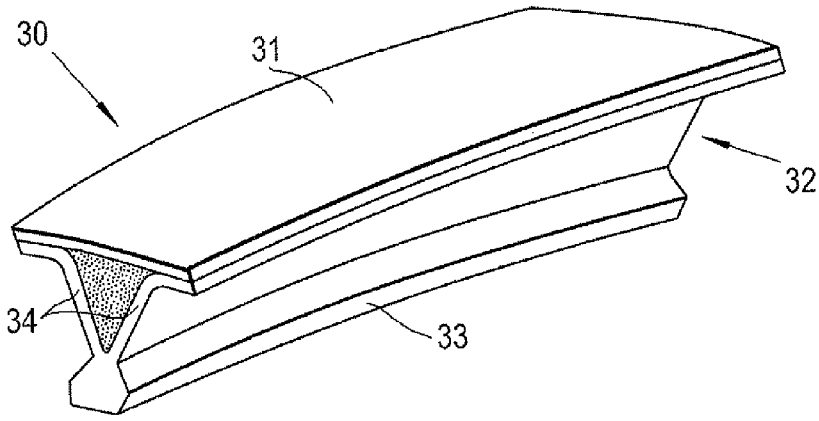
FIG. 2 shows schematically a perspective view of an annulus filler of an embodiment of the present invention.
Figure 3:
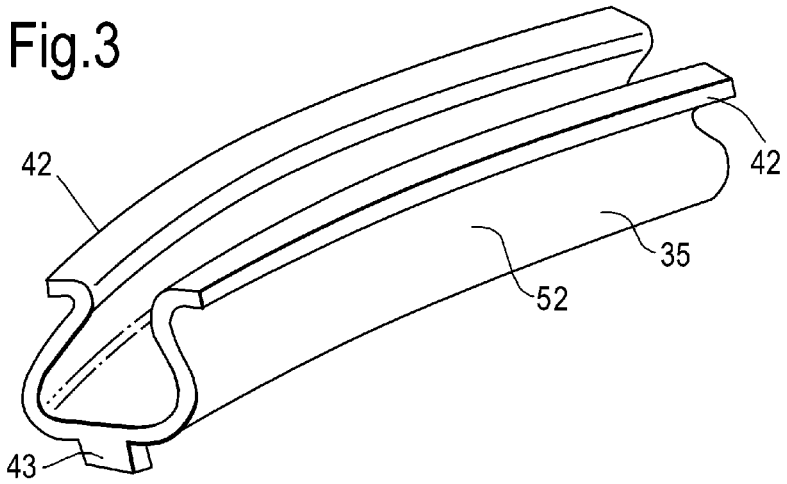
FIG. 3 shows schematically a perspective view of a retention sleeve of the embodiment.

FIGS. 2 and 3 show schematically perspective views of respectively an annulus filler 30 and a retention sleeve 35 of an annulus filler system according to an embodiment of the present invention. The filler has a lid 31 which, in use, extends between two adjacent composite fan blades, and a support body 32 extending beneath the lid and terminating in an elongate foot 33. The support body is formed by two side walls 34 which join to the lid along respective edges of the lid and meet at the foot to give the body a V-shaped cross-section. The foot has a dovetail cross-section, e.g. with about 55° flank angles. The retention sleeve 35 is shaped to wrap around the foot 33.

Figure 4:
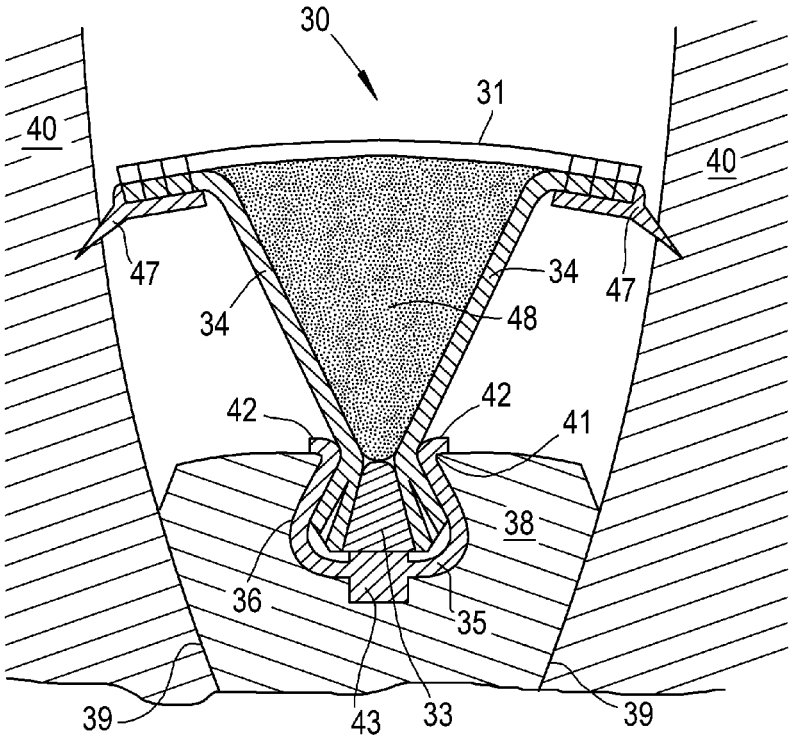
FIG. 4 shows schematically an end on view of the annulus filler and the retention sleeve of the embodiment when fitted to a groove of a rotor disc.
Figure 5:
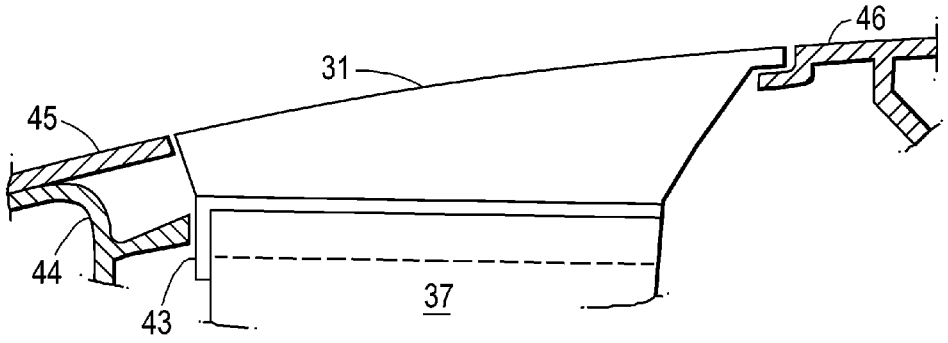
FIG. 5 shows schematically a side view of the fitted annulus filler and retention sleeve.

FIG. 4 shows schematically an end on view of the annulus filler 30 and the retention sleeve 35 when fitted to a groove 36 of a rotor disc, and FIG. 5 shows schematically a side view on the engine axial line of the fitted filler and sleeve. The groove is dovetail-shaped in cross-section, like the foot 33, and is located on the disc rim in the outside face of post 38 formed between slots 39 which hold the fan blades 40 to the disc. An alternative arrangement has a circular foot cross-section and a correspondingly circular groove cross-section. The groove may follow a straight or a curved path from the front to the rear of the disc, and the sleeve is correspondingly straight or curved. To install the annulus filler system into the groove, the annulus filler is positioned outwardly of the groove and then moved radially inwardly. The widest part of the foot is proportioned to pass through the neck 41 of the groove so that the foot can be located completely in the groove. This enables fitting annulus fillers between blades that are shaped such that the fillers cannot be slid into position along the groove in a generally rearward direction of the engine. To prevent withdrawal of the annulus filler in a radially outward direction, the retention sleeve 35 is slidingly located into the gap formed between the groove and the foot. The sleeve wraps around the foot and protrudes past the neck of the groove to flare outwardly away from the support body so that the free edges 42 of the sleeve are kept away from the support body 32. This helps to prevent the free edges from damaging the support body or posts 38 if there is relative movement between the sleeve and the body.

A stop 43 at the end of the sleeve 35 prevents the sleeve from sliding in one direction out of the groove 36. Sliding of the sleeve in the other direction can be prevented by a support ring 44 fitted to the face of the disc 37 after location of the sleeve. Thus together the stop and support ring can ensure repeatable axial positioning and retention of the sleeve.

When fitted, the lid 31 of the annulus filler 30 forms a continuous airflow surface along with a nose cone 45 at the front of the lid and a seal ring 46 at the rear of the lid. Sealing strips 47 extending along the edges of the lid seal the lid to the sides of the adjacent blades 40.

The composite fan blades 40 and their casing containment system are lighter weight compared to e.g. metal fan blades and their casing, and the containment system is sized accordingly. Thus, to reduce the risk of parts of the annulus filler 30 being released during an extreme event, such as a fan blade off or a large birdstrike, and striking the blades and/or casing, and also to reduce the risk of the filler imposing damaging contact stresses on the blades when the filler remains attached to the disc, the sleeve 35 is configured to allow the filler to rock with the blade movement associated with such an event while staying attached to the disc at the groove 36.

More particularly, the sleeve 35 can be formed from e.g. a ceramic, ceramic matrix composite or hard plastic. The sleeve can have one or more crush or frangible zones 51 e.g. formed of foamed material such as phenolic or ceramic foam, or (in the case of a plastic) by the selective addition of hardener to embrittle the material. In particular, a ceramic foam may be impregnated with a thermoplastic elastomer, a fluorocarbon, or a fluorosilicone to improve damping under extreme loads. These crush zones cause are activated during an extreme event to permanently change the shape of the sleeve. For example, the thickness of the sleeve may be reduced by about 35 to 80% in such a zone. In order to maintain the integrity of the sleeve, however, and prevent its uncontrolled failure, wire-reinforcement or fibre-reinforcement may be provided, e.g. as an external or internal layer of the sleeve. Under normal operation the crush zones should not be operated.

Figure 6:
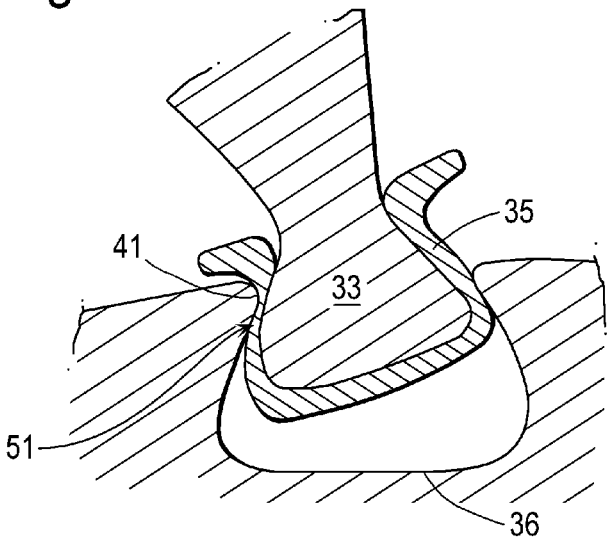
FIG. 6 shows schematically a cross-section of the foot of the filler during an extreme event.
Figure 7:
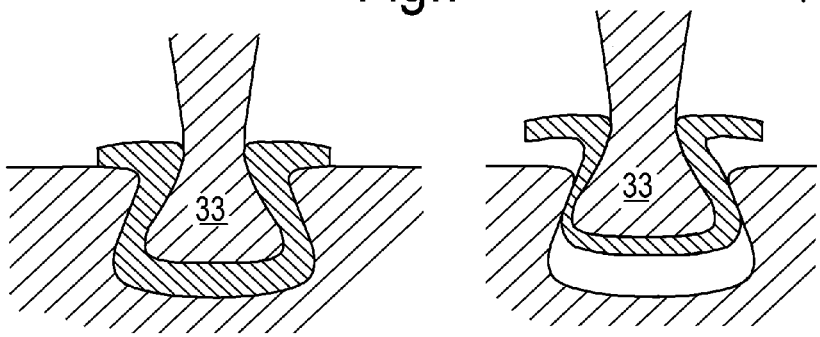
FIG. 7 shows schematically further cross-sections of the foot of the filler (a) before and (b) after the event.
Figure 8:
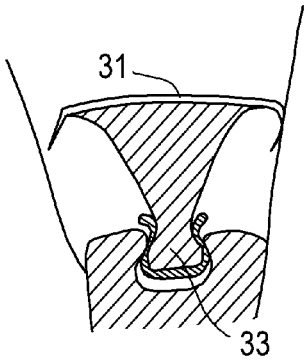
FIG. 8 shows schematically another end on view of the filler and the sleeve after the event.

Under normal centrifugal loads the filler 30 does not roll against the fan blades 40 due to the dovetail cross-sectional shape of the foot 33. FIG. 6 shows schematically, however, a cross-section of the foot during an extreme event. The sides of the sleeve 35 are crushed by the neck 41 of the groove 36, with the filler 30 lifting up and tilting to the side to adapt to the movement of the adjacent blades 40. The filler may rock back and tilt to the other side. FIG. 7 shows schematically further cross-sections of the foot (a) before and (b) after the event. Before the event the foot is held tightly in the groove by the sleeve. After the event, the foot is still held in the groove, but under centrifugal loading the crushed sides of the sleeve allow the filler to move radially outwardly under centrifugal loading leading to a clearance gap between the sleeve and the base of the groove. FIG. 8 shows schematically another end on view of the filler and the sleeve after the event, and illustrates how, although the filler is moved radially outwardly, the lid 31 is still close to its normal position.

In a straight sleeve 35, the crush zones may extend the length of the sleeve. However, in a curved sleeve, it may only be necessary to have the crush zones at e.g. the central section 52 of the sleeve, while the end sections may be configured to allow the filler 30 to rock about the foot 33.

Figure 9:
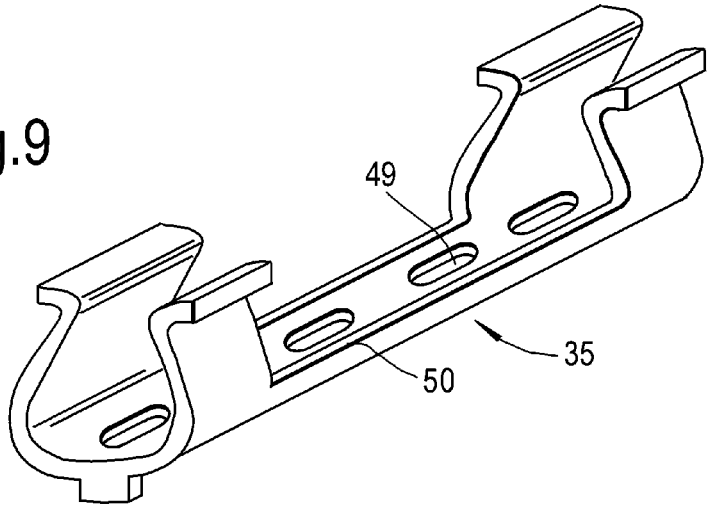
FIG. 9 shows schematically a perspective view of another embodiment of the sleeve.

FIG. 9 shows schematically a perspective view of another embodiment of the sleeve 35. In this case, the sleeve wraps around the foot and has crush zones only at its fore and aft ends, the zones being connected by a spine 50 which extends from front to rear of the sleeve and maintains the integrity of the sleeve during an extreme event. This arrangement locates the filler foot and reduces the weight of the sleeve. Further weight savings can be made by providing apertures 49 in the low stress areas of the sleeve.

Particularly in the case of a ceramic sleeve 35, the outer surface may need to be smooth to prevent abrasion against the surface of the groove 36. Additionally or alternatively, the outer surface of the sleeve may be treated with a lubricant, such as molybdenum disulphide or similar. An anti-frettage coating, such as a fluoropolymer like polytetrafluoroethylene, may be applied to the outer surface.

The sleeve 35 can act as an extreme event indicator. For example, if the set of sleeves move in their grooves 36 when the fan is rotated by hand, the fillers 30 can be seen to move and this may be a sign that the blades 40 have undergone an extreme event and should be inspected for damage, whether or not visible damage or indicators are present on the blades (such as bird blood). In carbon composite components, damage from an extreme event may not always be visible on the surface.

Advantageously, the foot 33 and groove 36 retention system can distribute loads over the entire axial length of the filler 30. This allows the use of a lightweight filler which can improve engine efficiency. The weight of the filler can be reduced, for example, by forming the lid 31, the side walls 34 and the foot 33 from carbon fibre reinforced plastic. The lid may be secured to the side walls by stitching through laminate layers, which can help to stiffen the edges of the lid, thereby providing a secure base for the sealing strips 47. The cavity formed by the lid and side walls can be filled with a foam core 48 or have an internal lattice structure, which can provide a lightweight resilient support to the lid and side walls. Such support can absorb impact energy and help the lid and side walls to retain their shape after impact deformation. The filler may be produced by foaming the material of the core within a pre-preg envelope of the lid, side walls and foot, and then completing the lid, side walls and foot by resin transfer moulding.

More specifically, the basic filler structure can be formed as a pre-preg tube by 3D Braiding or 3D weaving. A former can be placed inside the preform, which is then resin transfer moulded. The foam core is foamed in situ in the cavity and the surfaces sealed. The lid may have a coating, such as an elastomer (e.g. polyurethane), applied to resist sand, debris, and tool drops. Typically the coating would be applied as a sheet or sprayed on. A more sophisticated 3D braided or woven structure can be made to provide internal struts or lattice within the cavity, in which case more than one former may be required during moulding.

Although the primary intention is to retain the attachment of the filler 30 in the groove 36, a line of weakness at the connection of the foot 33 to the support body 32 may be provided, allowing the support body and the lid 31 to break away from the foot in case of an event so extreme that retention of the filler would cause more damage than loss of the filler lid.

While the invention has been described in conjunction with the exemplary embodiments described above, many equivalent modifications and variations will be apparent to those skilled in the art when given this disclosure. For example, a deformable sleeve which allows a rocking movement of the filler about its foot in response to extreme lateral movement of the adjacent blades may also be usefully applied in a system in which the filler can be slid into position along the groove in a generally rearward direction of the engine, i.e. in which the sleeve does not need to prevent withdrawal of the annulus filler in a radially outward direction. Accordingly, the exemplary embodiments of the invention set forth above are considered to be illustrative and not limiting.

All references referred to above are hereby incorporated by reference.

The invention claimed is:

1. An annulus filler system for bridging the gap between two adjacent blades attached to a rim of the rotor disc of a gas turbine engine, the system including:

an annulus filler having a lid which extends between the adjacent blades and defines an airflow surface for air being drawn through the engine, and a support body extending beneath the lid and terminating in an elongate foot which, in use, extends along a groove provided in the rim of the disc, the groove having a neck which prevents withdrawal of the foot through the neck in a radially outward direction of the disc; and a sleeve which, after installation of the filler, is slidably locatable into a gap between the foot and sides of the groove, wherein the sleeve has one or more frangible zones located within the groove and contacting both the neck and the foot of the annulus filler, the frangible zone provides permanent deformation to allow a rocking movement of the filler about the foot in response to lateral movement of the adjacent blades which is at least of a magnitude to cause the adjacent blades to contact each other, the sleeve having a pair of first and second sidewalls, each of the first and second sidewalls extending between a stop and a respective sidewall free edge, at least one of the frangible zones being located along the first sidewall between the stop and the sidewall free edge of the first sidewall.

2. The annulus filler system according to claim 1, wherein:

the foot is proportioned to pass through the neck of the groove in a radial direction on installation of the filler;

the sleeve is proportioned to prevent withdrawal of the foot through the neck, after installation of the filler, in a radially outward direction of the disc, and the sleeve is further configured to retain sufficient integrity after said permanent deformation to still prevent withdrawal of the foot through the neck in a radially outward direction of the disc.

3. The annulus filler system according to claim 1, wherein the frangible zone or zones are provided by a foamed material selected from the group comprising: phenolic or ceramic foam, or a plastic embrittled by the selective addition of hardener.

4. The annulus filler system according to claim 3, wherein the frangible zone is provided by a ceramic foam impregnated with a thermoplastic elastomer, a fluorocarbon, or a fluorosilicone.

5. The annulus filler system according to claim 1, wherein the sleeve is at least partially wire-reinforced or fibre-reinforced to maintain the integrity of the sleeve after the deformation.

6. The annulus filler system according to claim 5, wherein the wire or fibre reinforcement join the frangible zone to a spine or non frangible zone.

7. The annulus filler system according to claim 1, wherein a frangible zone is provided by a central section of the sleeve, the end sections being a non frangible zone.

8. The annulus filler system according to claim 1, wherein the sleeve is configured to protrude past the neck of the groove and to flare outwardly away from the support body.

9. The annulus filler system according to claim 8, wherein the sleeve protrudes past the neck of the groove and to flare outwardly away from opposing sides of the support body.

10. The annulus filler system according to claim 1, wherein the support body has a pair of side walls, each side wall joining a respective edge of the lid to the foot to give the support body a V-shaped cross-section.

11. The annulus filler system according to claim 10, wherein the side walls are formed from fibre-reinforced plastic.

12. The annulus filler system according to claim 10, wherein a cavity formed by the lid and the two side walls contains a foam core.

13. A rotor assembly for a gas turbine engine including:

a rotor disc, a plurality of blades attached to a rim of the disc of a gas turbine engine, and annulus filler systems according to claim 1 bridging the gaps between adjacent blades;

wherein respective grooves are provided in the rim, the feet of the annulus fillers extending along the grooves, and the sleeves being located in the gaps between the feet and the sides of the grooves.

14. The annulus filler system according to claim 1, wherein the stop and the sidewall free edge of the first sidewall have no frangible zones such that, upon the permanent deformation to allow the rocking movement, deformation occurs at the at least one frangible zone but not at the stop or the sidewall free edge of the first sidewall.

15. The annulus filler system according to claim 1, wherein the sidewall free edge is outside the groove.

* * * * *